US008309499B2

(12) United States Patent
Kamano

(10) Patent No.: US 8,309,499 B2
(45) Date of Patent: Nov. 13, 2012

(54) LUBRICANT COMPOSITION FOR INTERNAL COMBUSTION ENGINE

(75) Inventor: Hideki Kamano, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 12/439,210

(22) PCT Filed: Sep. 3, 2007

(86) PCT No.: PCT/JP2007/067121

§ 371 (c)(1),
(2), (4) Date: Feb. 27, 2009

(87) PCT Pub. No.: WO2008/029756

PCT Pub. Date: Mar. 13, 2008

(65) Prior Publication Data

US 2009/0203561 A1 Aug. 13, 2009

(30) Foreign Application Priority Data

Sep. 4, 2006 (JP) ..... 2006-238888

(51) Int. Cl.
*C10M 135/22* (2006.01)
*C10M 169/04* (2006.01)
*C10M 159/18* (2006.01)

(52) U.S. Cl. ..... 508/569; 508/287; 508/362

(58) Field of Classification Search ..... 508/287, 508/362, 569

See application file for complete search history.

(56) References Cited

U.S. PATENT DOCUMENTS

| | | | | |
|---|---|---|---|---|
| 2,691,000 | A | 10/1954 | Elliott et al. | |
| 4,370,246 | A | 1/1983 | deVries et al. | |
| 5,141,658 | A * | 8/1992 | DiBiase | 508/192 |
| 5,705,458 | A * | 1/1998 | Roby et al. | 508/445 |
| 6,063,741 | A | 5/2000 | Naitoh et al. | |
| 7,309,680 | B2 | 12/2007 | John et al. | |
| 2002/0019320 | A1 * | 2/2002 | Nakazato et al. | 508/159 |
| 2003/0182847 | A1 | 10/2003 | Katafuchi | |
| 2005/0034358 | A1 | 2/2005 | Katafuchi | |
| 2006/0148663 | A1 | 7/2006 | Shimizu | |
| 2007/0049506 | A1 | 3/2007 | Katafuchi et al. | |
| 2008/0045424 | A1 * | 2/2008 | Shimizu et al. | 508/509 |

FOREIGN PATENT DOCUMENTS

| | | |
|---|---|---|
| EP | 0 768 366 | 4/1997 |
| JP | 3 22438 | 3/1991 |
| JP | 8 73878 | 3/1996 |
| JP | 10 46177 | 2/1998 |
| JP | 2001 262175 | 9/2001 |
| JP | 2003 500521 | 1/2003 |
| JP | 2003 523454 | 8/2003 |
| JP | 2003 252887 | 9/2003 |
| JP | 2003 336089 | 11/2003 |
| JP | 2004 002866 | 1/2004 |
| JP | 2004 051985 | 2/2004 |
| JP | 2007 63431 | 3/2007 |
| WO | 02 16532 | 2/2002 |
| WO | 2004 069966 | 8/2004 |
| WO | 2006 013946 | 2/2006 |

OTHER PUBLICATIONS

U.S. Appl. No. 12/602,130, filed Nov. 27, 2009, Ito.
Supplementary European Search Report dated Jul. 5, 2011.

* cited by examiner

*Primary Examiner* — Cephia D Toomer
*Assistant Examiner* — Vishal Vasisth
(74) *Attorney, Agent, or Firm* — Oblon, Spivak, McClelland, Maier & Neustadt, L.L.P.

(57) ABSTRACT

A lubricating oil composition for internal combustion engines, containing a base oil, (A) at least one compound selected from disulfide compounds represented by the following general formula (I):

$$R^1OOC\text{-}A^1\text{-}S\text{—}S\text{-}A^2\text{-}COOR^2 \quad (I)$$

and disulfide compounds represented by the following general formula (II):

$$R^7OOC\text{—}CR^9R^{10}\text{—}CR^{11}(COOR^8)\text{—}S\text{—}S\text{—}CR^{16}(COOR^{13})\text{—}CR^{14}R^{15}\text{—}COOR^{12} \quad (II),$$

(B) an organomolybdenum compound, and (C) a phenol-based antioxidant and/or an amine-based antioxidant. The lubricating oil composition is a low ash, low phosphorus lubricating oil composition which is used for internal combustion engines such as gasoline engines, diesel engines and gas engines, which has improved oxidation stability and friction reducing effect, and which complies with environmental regulations.

9 Claims, No Drawings

LUBRICANT COMPOSITION FOR INTERNAL COMBUSTION ENGINE

This application is a 371 of PCT/JP2007/067121, filed Sep. 3, 2007.

TECHNICAL FIELD

The present invention relates to a lubricating oil composition for internal combustion engines and, more specifically, to a lubricating oil composition for internal combustion engines which exhibits improved oxidation stability and friction reducing effect using a combination of a specific sulfur compound, an organomolybdenum compound and a phenol-based antioxidant and/or an amine-based antioxidant.

BACKGROUND ART

At present, environmental regulations become more and more severe on global scale. Specifically, circumstances surrounding the automobile industry, such as fuel consumption regulations and exhaust gas emission regulations, become increasingly more severe. In the background of such severe regulations, there are environmental problems, such as global warming, and necessity for resource conservation as a result of possible depletion of petroleum resources. Therefore, reduction of fuel consumption of automobiles is considered to be further advanced.

In order to reduce fuel consumption in automobiles, not only an improvement of automobiles per se, such as reduction of the weight thereof and improvement of engines but also an improvement of an engine oil, such as reduction of the viscosity thereof and addition of a good friction regulating agent for the prevention of frictional loss in the engine, is also important. A reduction of the viscosity of an engine oil, however, causes an increase of wear of engine components. Thus, for the purpose of reducing frictional loss, which might be caused by a reduction of the viscosity of an engine oil, and preventing wear, a friction modifier, an extreme pressure agent, etc. are added. As the extreme pressure agent, generally used is a phosphorus-containing compound. The phosphorus-containing compound is, however, known to deteriorate a catalyst used for purifying the exhaust gas. Therefore, it is desired to reduce the amount of such a phosphorus-containing compound in the engine oil as much as possible.

In diesel engines, it is an important problem to provide a method for reducing environmental pollution caused by exhaust gas components such as particulate matter (PM) and NOx. One effective solution to this problem is to mount an exhaust gas purifying device using a particulate filter or an exhaust gas purifying catalyst (oxidation or reduction catalyst) on automobiles. When a conventional lubricating oil for internal combustion engines is used in an automobile provided with such an exhaust gas purifying device, a problem arises because, although soot which deposits on the particulate filter is removed by oxidation and combustion, the filter is clogged by metal oxides, phosphate salts, sulfate salts and carboxylate salts that are formed in situ by the combustion. Part of the engine oil used is combusted and discharged as an exhaust gas. Therefore, it is preferable to maintain the content of metal components and sulfur components in the lubricating oil at as low level as possible. It is also preferable to reduce the content of phosphorus components and sulfur components in the lubricant oil for reasons of prevention of catalyst degradation.

In this circumstance, a lubricating oil composition for a diesel engine provided with a diesel particulate filter (DPF) is disclosed which is capable of reducing clogging of DPF by an ash component, capable of improving the combustibility of PM caught by DPF, capable of stably combusting PM at a low temperature, capable of improving the removing efficiency thereof, and capable of prolonging the service life of DPF (see, for example, Patent Document 1). The lubricant oil composition for a diesel oil engine provided with a device for removing diesel particulate matters is characterized in that the composition has a sulfated ash content of 1.0% by weight or less, a sulfur component content of 0.3% by weight or less and a molybdenum content of 100 ppm or more.

As an extreme pressure additive for a lubricant oil, a phosphorus-based or sulfur-based extreme pressure agent has been hitherto generally used. The extreme pressure agent which contains a phosphorus atom and/or a sulfur atom in its molecule is dissolved or uniformly dispersed in a base oil to exhibit the extreme pressure behavior. Examples of the known extreme pressure agent include metal salts of dithiophosphoric acid, sulfurized fats, sulfurized fatty acids, sulfurized esters, polysulfides, sulfurized olefins, thiocarbamates, thioterpenes and dialkyl thiodipropionates. These extreme pressure additives, however, have problems that metals are corroded by them, seizure preventing effect is not sufficiently achieved due to interaction thereof with other additives and oxidation stability is insufficient and, therefore, are not fully satisfactory.

In this circumstance, the present applicant has developed a novel sulfur-based extreme pressure additive which has better load carrying capacity and wear resistance as compared with the conventional extreme pressure additive, which is less corrosive to metals, which can be used for lubricating oils and which comprises a disulfide compound having a specific structure (see, for example, Patent Documents 2 and 3).

It is known that an improvement of wear resistance, an improvement of oxidation stability, an improvement of anti-deposit property and an improvement of reduction of friction may be obtained, when a molybdenum-containing additive is added to a lubricating oil such as an engine oil for passenger cars, a heavy-load diesel engine oil or a natural gas engine oil (see, for example, Patent Documents 4 to 10). As the molybdenum-containing additive, there may be mentioned, for example, organomolybdenum compounds such as sulfurized oxymolybdenum dithiocarbamate, sulfurized oxymolybdenum dithiophosphate, sulfurized oxymolybdenum dithioxanthogenate, molybdenum-amine complexes, trinuclear molybdenum-sulfur compounds and sulfur-containing molybdenum complexes of succinimide.

[Patent Document 1] Japanese Unexamined Patent Application Publication No. 2002-60776
[Patent Document 2] Japanese Unexamined Patent Application Publication No. 2004-262964
[Patent Document 3] Japanese Unexamined Patent Application Publication No. 2006-45335
[Patent Document 4] Japanese Unexamined Patent Application Publication No. 2001-262175
[Patent Document 5] Japanese Unexamined Patent Application Publication No. 2003-252887
[Patent Document 6] Japanese Translation of PCT International Application Publication No. 2003-523454
[Patent Document 7] Japanese Translation of PCT International Application Publication No. 2003-500521
[Patent Document 8] Japanese Unexamined Patent Application Publication No. 2004-51985
[Patent Document 9] Japanese Examined Patent Publication No. H03-22438
[Patent Document 10] Japanese Unexamined Patent Application Publication No. 2004-2866

DISCLOSURE OF THE INVENTION

Problem to be Solved by the Invention

Under the above-mentioned circumstance, the present invention has as its object the provision of a lubricating oil composition which is low ash and low phosphorus, which is used for internal combustion engines such as gasoline engines, diesel engines and gas engines, which has improved oxidation stability and friction reducing effect, and which complies with environmental regulations.

Means for Solving the Problem

The present inventors have made an earnest study with a view toward developing a lubricating oil composition having the above-described preferable properties and have found that addition of a disulfide compound having a specific structure can improve the friction reducing effect and use of an organomolybdenum compound together with a phenol-based antioxidant and/or an amine-based antioxidant can improve the retentivity of the friction reducing effect and oxidation stability so that the above objects can be accomplished. The present invention has been completed based on the above finding.

That is, the present invention provides:

[1] A lubricating oil composition for internal combustion engines, comprising a base oil, (A) at least one compound selected from the group consisting of disulfide compounds represented by the following general formula (I):

$$R^1OOC\text{-}A^1\text{-}S\text{—}S\text{-}A^2\text{-}COOR^2 \quad (I)$$

(wherein $R^1$ and $R^2$ each independently represent a $C_1$ to $C_{30}$ hydrocarbyl group which may contain an oxygen atom, a sulfur atom or a nitrogen atom, $A^1$ and $A^2$ each independently represent a group of the formula $CR^3R^4$ or $CR^3R^4$—$CR^5R^6$ where $R^3$ to $R^6$ each independently represent a hydrogen atom or a $C_1$ to $C_{20}$ hydrocarbyl group), and disulfide compounds represented by the following general formula (II):

$$R^7OOC\text{—}CR^9R^{10}\text{—}CR^{11}(COOR^8)\text{—}S\text{—}S\text{—}CR^{16}(COOR^{13})\text{—}CR^{14}R^{15}\text{—}COOR^{12} \quad (II),$$

(wherein $R^7$, $R^8$, $R^{12}$ and $R^{13}$ each independently represent a $C_1$ to $C_{30}$ hydrocarbyl group which may contain an oxygen atom, a sulfur atom or a nitrogen atom and $R^9$ to $R^{11}$ and $R^{14}$ to $R^{16}$ each independently represent a hydrogen atom or a $C_1$ to $C_5$ hydrocarbyl group), (B) an organomolybdenum compound, and (C) a phenol-based antioxidant and/or an amine-based antioxidant;

[2] The lubricating oil composition for internal combustion engines according to above [1], further comprising (D) a metal-based detergent and/or an ashless dispersant;

[3] The lubricating oil composition for internal combustion engines according to above [1], wherein the lubricating oil composition has a molybdenum content of 2,000 ppm or less.

[4] The lubricating oil composition for internal combustion engines according to any one of above [1] or [2], wherein the lubricating oil composition has a sulfur content of 0.3% by mass or less.

[5] The lubricating oil composition for internal combustion engines according to above [1], wherein the lubricating oil composition has a phosphorus content of 0.1% by mass or less.

[6] The lubricating oil composition for internal combustion engines according to any one of above [1] or [2], wherein the lubricating oil composition has a sulfated ash content of 1.0% by mass or less.

Effect of the Invention

According to the present invention, by using a disulfide compound having a specific structure together with an organomolybdenum compound and a phenol-based antioxidant and/or an amine-based antioxidant, there can be provided a lubricating oil composition for internal combustion engines, which is low ash and low phosphorus, which has improved oxidation stability and friction reducing effect and which complies with environmental regulations, specifically a lubricating oil composition which is used for internal combustion engines such as gasoline engines, diesel engines and gas engines.

BEST MODE FOR CARRYING OUT THE INVENTION

A lubricating oil composition for internal combustion engines of the present invention (hereinafter occasionally referred to simply as "lubricating oil composition") is characterized in that the composition contains a base oil, (A) a disulfide compound, (B) an organomolybdenum compound, and (C) a phenol-based antioxidant and/or an amine-based antioxidant.

The base oil used in the lubricating oil composition of the present invention is not specifically limited and may be arbitrarily selected from those mineral oils and synthetic oils which are conventionally used as a base oil for lubricating oils for internal combustion engines.

As the mineral oil, there may be mentioned, for example, refined mineral oil obtained by subjecting a lubricating oil fraction, which is obtained by vacuum distillation of a residual oil obtained by atmospheric distillation of crude oil, to one or more processes selected from solvent deasphalting, solvent extraction, hydrocracking, solvent dewaxing, catalytic dewaxing, hydrorefining and other processes; and mineral oil produced by isomerization of wax or GTL WAX.

As the synthetic oil, there may be mentioned, for example, polybutene; polyolefins such as homopolymers and copolymers of an α-olefin (for example, ethylene-α-olefin copolymers); various kinds of esters such as polyol esters, dibasic acid esters and phosphate esters; various kinds of ethers such as polyphenyl ethers; polyglycols; alkylbenzenes; and alkylnaphthalenes. Among these synthetic oils, polyolefins and polyol esters are particularly preferred.

In the present invention, the above-mentioned mineral oils may be used singly or in combination of two or more thereof as the base oil. Similarly, the above-mentioned synthetic oils may be used singly or in combination of two or more thereof. Further, one or more mineral oils and one or more synthetic oils may be used in combination.

The viscosity of the base oil is not particularly limited. The kinematic viscosity at 100° C. of the base oil is generally 2 to 30 $mm^2/s$, preferably 3 to 15 $mm^2/s$, more preferably 4 to 10 $mm^2/s$, although the viscosity range varies with the intended use of the lubricating oil composition. When the kinematic viscosity is 2 $mm^2/s$ or more at 100° C., an evaporation loss is small. On the other hand, when the kinematic viscosity is 30 $mm^2/s$ or less, a dynamic loss by viscosity resistance is not excessively large so that an effect of reducing fuel consumption is obtainable.

The base oil preferably has a % CA, as determined by ring analysis, of 3.0 or less and a sulfur content of 50 ppm by mass or less. As used herein, "% CA as determined by ring analysis" is intended to refer to a percentage of aromatic carbon calculated in accordance with the n-d-M ring analysis method, and "sulfur content" is as measured in accordance with JIS K2541.

A base oil having a % CA of 3.0 or less and a sulfur content of 50 ppm by mass or less has good oxidation stability, can prevent increase of the acid value and formation of sludge, and can also provide a lubricating oil composition that is less corrosive to metals.

The % CA of the base oil is preferably 1.0 or less, more preferably 0.5 or less, and the sulfur content thereof is preferably 30 ppm by mass or less.

Further, the viscosity index of the base oil is preferably 70 or more, more preferably 100 or more, still more preferably 120 or more. When the viscosity index is 70 or more, temperature dependency of the viscosity of the base oil is small.

In the lubricating oil composition of the present invention, (A) a disulfide compound of a specific structure is used together with (B) an organomolybdenum compound and (C) a phenol-based antioxidant and/or an amine-based antioxidant for the purpose of obtaining good oxidation stability and an effect of reducing coefficient of friction.

As the disulfide compound of component (A), (a-1) at least one compound selected from disulfide compounds represented by the following general formula (I):

$$R^1OOC\text{-}A^1\text{-}S\text{—}S\text{-}A^2\text{-}COOR^2 \quad (I)$$

and (a-2)disulfide compounds represented by the following general formula (II):

$$R^7OOC\text{—}CR^9R^{10}\text{—}CR^{11}(COOR^8)\text{—}S\text{—}S\text{—}CR^{16}(COOR^{13})\text{—}CR^{14}R^{15}\text{—}COOR^{12} \quad (II),$$

is used.

In the general formula (I), $R^1$ and $R^2$ each independently represent a $C_1$ to $C_{30}$, preferably $C_1$ to $C_{20}$, more preferably $C_2$ to $C_{18}$, particularly preferably $C_3$ to $C_{18}$ hydrocarbyl group. The hydrocarbyl group may be straight-chained, branched or cyclic and may contain an oxygen atom, a sulfur atom or a nitrogen atom. The groups $R^1$ and $R^2$ may be the same as or different from each other but are preferably the same as each other for reasons of simplicity of the production method.

The symbols $A^1$ and $A^2$ each independently represent a group of the formula $CR^3R^4$ or $CR^3R^4$—$CR^5R^6$ where $R^3$ to $R^6$ each independently represent a hydrogen atom or a $C_1$ to $C_{20}$, preferably $C_1$ to $C_{12}$, more preferably $C_1$ to $C_8$ hydrocarbyl group. The groups $A^1$ and $A^2$ may be the same as or different from each other but are preferably the same as each other for reasons of simplicity of the production method.

It is preferred that the content of polysulfide compounds having 3 or more sulfur atoms in the compound of the general formula (I) is 30% by mass or less based on the total amount of the polysulfide compounds and the disulfide compound. When the above content is 30% or less, the corrosive property of the compound of the general formula (I) to nonferrous metals can be sufficiently suppressed. The content of the polysulfide compounds having 3 or more sulfur atoms is more preferably 10% by mass or less, still more preferably 5% by mass or less.

Therefore, it is important that, in the production of the disulfide compound represented by the general formula (I), a process should be used so that the yield of a by-product of the polysulfide compounds having 3 or more sulfur atoms is within the above range. The disulfide compound of the general formula (I) may be produced, for example, by the following process.

Namely, oxidative coupling is conducted using as the raw material an ester of a mercaptoalkanecarboxylic acid represented by the general formula (III) and/or the general formula (IV):

$$R^1OOC\text{-}A^1\text{-}SH \quad (III)$$

$$R^2OOC\text{-}A^2\text{-}SH \quad (IV)$$

(wherein $R^1$, $R^2$, $A^1$ and $A^2$ are as defined above)

By using the above method, substantially no polysulfide compounds are by-produced. That is, produced are only $R^1OOC\text{-}A^1\text{-}S\text{—}S\text{-}A^2\text{-}COOR^2$, $R^1OOC\text{-}A^1\text{-}S\text{—}S\text{-}A^1\text{-}COOR^1$, and $R^2OOC\text{-}A^2\text{-}S\text{—}S\text{-}A^2\text{-}COOR^2$.

As the oxidizing agent used for oxidation of an ester of an α-mercaptocarboxylic acid to produce the corresponding disulfide, there may be used an oxidizing agent that is used in the production of a disulfide from a mercaptan. Examples of the oxidizing agent include oxygen, hydrogen peroxide, halogens such as iodine and bromine, hypohalous acids and hypohalites, sulfoxides such as dimethyl sulfoxide and diisopropyl sulfoxide, and manganese (IV) oxide. Among these oxidizing agents, oxygen, hydrogen peroxide and dimethyl sulfoxide are preferable since they are inexpensive and permit the production of the disulfide in a facilitated manner.

In the above general formula (II), $R^7$, $R^8$, $R^{12}$ and $R^{13}$ each independently represent a $C_1$ to $C_{30}$, preferably $C_1$ to $C_{20}$, more preferably $C_2$ to $C_{18}$, particularly preferably $C_3$ to $C_{18}$ hydrocarbyl group. The hydrocarbyl group may be straight-chained, branched or cyclic and may contain an oxygen atom, a sulfur atom or a nitrogen atom. The groups $R^7$, $R^8$, $R^{12}$ and $R^{13}$ may be the same as or different from each other but are preferably the same as each other for reasons of simplicity of the production method.

The symbols $R^9$ to $R^{11}$ and $R^{14}$ to $R^{16}$ each independently represent a hydrogen atom or a $C_1$ to $C_5$ hydrocarbyl group and preferably a hydrogen atom for reasons of availability.

The disulfide compound represented by the general formula (II) may be produced, for example, by the following two processes. The first process involves oxidative coupling of a mercaptoalkane dicarboxylic acid diester represented by the general formula (V) and/or the general formula (VI) as a raw material:

$$R^7OOC\text{—}CR^9R^{10}\text{—}CR^{11}(COOR^8)\text{—}SH \quad (V)$$

$$R^{12}OOC\text{—}CR^{14}R^{15}\text{—}CR^{16}(COOR^{13})\text{—}SH \quad (VI)$$

wherein $R^7$ to $R^{16}$ are as defined above.

Specifically, the following compounds are produced.

$$R^7OOC\text{—}CR^9R^{10}\text{—}CR^{11}(COOR^8)\text{—}S\text{—}S\text{—}CR^{16}(COOR^{13})\text{—}CR^{14}R^{15}\text{—}COOR^{12},$$

$$R^7OOC\text{—}CR^9R^{10}\text{—}CR^{11}(COOR^8)\text{—}S\text{—}S\text{—}CR^{11}(COOR^8)\text{—}CR^9R^{10}\text{—}COOR^7, \text{ and}$$

$$R^{12}OOC\text{—}CR^{14}R^{15}\text{—}CR^{16}(COOR^{13})\text{—}S\text{—}S\text{—}CR^{16}(COOR^{13})\text{—}CR^{14}R^{15}\text{—}COOR^{12}.$$

As an oxidizing agent for the oxidative coupling, there may be used the same oxidation agent as in the production of the disulfide compound of the general formula (I).

The second process for producing the above disulfide compound involves oxidative coupling of a mercaptoalkane dicarboxylic acid represented by the general formula (VII) and/or the general formula (VIII) as a raw material:

$$HOOC\text{—}CR^9R^{10}\text{—}CR^{11}(COOH)\text{—}SH \quad (VII)$$

$$HOOC\text{—}CR^{14}R^{15}\text{—}CR^{16}(COOH)\text{—}SH \quad (VIII)$$

wherein $R^9$ to $R^{11}$ and $R^{14}$ to $R^{16}$ are as defined above. After the oxidative coupling, the product is esterified with a monohydric alcohol which has a $C_1$ to $C_{30}$ hydrocarbyl group and which may contain an oxygen, sulfur or nitrogen atom.

Specifically, the following compounds are produced.

$$HOOC—CR^9R^{10}—CR^{11}(—COOH)—S—S—CR^{16}(COOH)—CR^{14}R^{15}—COOH,$$

$$HOOC—CR^9R^{10}—CR^{11}(—COOH)—S—S—CR^{11}(COOH)—CR^9R^{10}—COOH, \text{ and}$$

$$HOOC—CR^{14}R^{15}—CR^{16}(—COOH)—S—S—CR^{16}(COOH)—CR^{14}R^{15}—COOH$$

In this case, the above-described oxidizing agent may be also used.

After the oxidative coupling, the product is esterified with an alcohol represented by the following general formula (IX):

$$R^{17}—OH \quad (IX)$$

wherein $R^{17}$ represents the same group as defined for $R^7$, $R^8$, $R^{12}$ and $R^{13}$.

The esterification may be carried out by an ordinary method, namely by dehydrative condensation using an acid catalyst. Specifically, the following compounds are produced:

$$R^{17}OOC—CR^9R^{10}—CR^{11}(COOR^{17})—S—S—CR^{16}(COOR^{17})—CR^{14}R^{15}—COOR^{17},$$

$$R^{17}OOC—CR^9R^{10}—CR^{11}(COOR^{17})—S—S—CR^{11}(COOR^{17})—CR^9R^{10}—COOR^{17}, \text{ and}$$

$$R^{17}OOC—CR^{14}R^{15}—CR^{16}(COOR^{17})—S—S—CR^{16}(COOR^{17})—CR^{14}R^{15}—COOR^{17}.$$

Examples of the disulfide compound represented by the general formula (I) include bis(methoxycarbonylmethyl) disulfide, bis(ethoxycarbonylmethyl)disulfide, bis(n-propoxycarbonylmethyl) disulfide, bis(isopropoxycarbonylmethyl) disulfide, bis(n-butoxycarbonylmethyl) disulfide, bis(n-octoxycarbonyl-methyl) disulfide, bis(n-dodecyloxycarbonylmethyl)disulfide, bis(cyclopropoxycarbonylmethyl)disulfide, 1,1-bis(1-methoxycarbonylethyl)disulfide, 1,1-bis(1-methoxycarbonyl-n-propyl) disulfide, 1,1-bis(1-methoxycarbonyl-n-butyl) disulfide, 1,1-bis(1-methoxycarbonyl-n-hexyl)disulfide, 1,1-bis(1-methoxycarbonyl-n-octyl)disulfide, 1,1-bis(1-methoxycarbonyl-n-dodecyl)disulfide, 2,2-bis(2-methoxycarbonyl-n-propyl)disulfide, α,α-bis(α-methoxycarbonylbenzyl)disulfide, 1,1-bis(2-methoxycarbonylethyl)disulfide, 1,1-bis(2-ethoxycarbonylethyl)disulfide, 1,1-bis(2-n-propoxycarbonylethyl) disulfide, 1,1-bis(2-isopropoxycarbonylethyl) disulfide, 1,1-bis(2-cyclopropoxycarbonylethyl)disulfide, 1,1-bis(2-methoxycarbonyl-n-propyl)disulfide, 1,1-bis(2-methoxycarbonyl-n-butyl)disulfide, 1,1-bis(2-methoxycarbonyl-n-hexyl) disulfide, 1,1-bis(2-methoxycarbonyl-n-propyl) disulfide, 2,2-bis(3-methoxycarbonyl-n-pentyl)disulfide and 1,1-bis(2-methoxycarbonyl-1-phenylethyl)disulfide.

Examples of the disulfide compound represented by the general formula (II) include tetramethyl dithiomalate, tetraethyl dithiomalate, tetra-1-propyl dithiomalate, tetra-2-propyl dithiomalate, tetra-1-butyl dithiomalate, tetra-2-butyl dithiomalate, tetraisobutyl dithiomalate, tetra-1-hexyl dithiomalate, tetra-1-octyl dithiomalate, tetra-1-(2-ethyl)hexyl dithiomalate, tetra-1-(3,5,5-trimethyl)hexyl dithiomalate, tetra-1-decyl dithiomalate, tetra-1-dodecyl dithiomalate, tetra-1-hexadecyl dithiomalate, tetra-1-octadecyl dithiomalate, tetrabenzyl dithiomalate, tetra-α-(methyl)benzyl dithiomalate, tetra-α,α-dimethylbenzyl dithiomalate, tetra-1-(2-methoxy)ethyl dithiomalate, tetra-1-(2-ethoxy)ethyl dithiomalate, tetra-1-(2-butoxy)ethyl dithiomalate, tetra-1-(2-ethoxy)ethyl dithiomalate, tetra-1-(2-butoxy-butoxy) ethyl dithiomalate and tetra-1-(2-phenoxy)ethyl dithiomalate.

In the present invention, the disulfide compounds of component (A) may be used singly or in combination of two or more thereof.

The content of component (A) is advantageously determined so that the lubricating oil composition has a total sulfur content of preferably 0.3% by mass or less, more preferably 0.05 to 0.2% by mass, from the viewpoint of a balance between the effect, influence upon the exhaust gas purifying catalyst and economical efficiency.

In the lubricating oil composition of the present invention, the disulfide compound of component (A) must be used together with an organomolybdenum compound as component (B) and a phenol-based antioxidant and/or an amine-based antioxidant as component (C).

The organomolybdenum compound as component (B) may be selected from a variety of compounds such as sulfurized oxymolybdenum dithiocarbamate (MoDTC), sulfurized oxymolybdenum dithiophosphate (MoDTP), sulfurized oxymolybdenum dithioxantogenate (MoDTX), molybdenum-amine complexes, trinuclear molybdenum-sulfur compounds and sulfur-containing molybdenum complexes of succinimide.

Sulfurized oxymolybdenum dithiocarbamate (MoDTC), sulfurized oxymolybdenum dithiophosphate (MoDTP), and sulfurized oxymolybdenum dithioxantogenate (MoDTX) are represented by the following general formulas (X), (XI) and (XII), respectively.

[Chemical Formula 1]

(X)

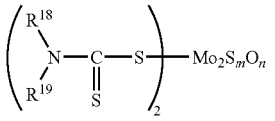

(XI)

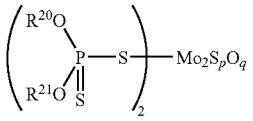

(XII)

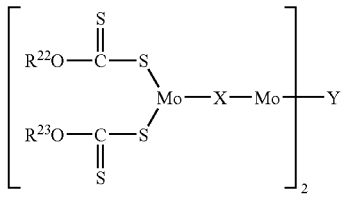

In the general formula (X), $R^{18}$ and $R^{19}$ each represent a $C_5$ to $C_{23}$ hydrocarbon group and may be the same as or different from each other. As the $C_5$ to $C_{23}$ hydrocarbon group, there may be mentioned a $C_5$ to $C_{23}$ straight-chained or branched alkyl or alkenyl group, and $C_6$ to $C_{23}$ cycloalkyl, aryl, alkylaryl and arylalkyl groups. The hydrocarbon group preferably has 8 to 23 carbon atoms. Specific examples of the hydrocarbon group include a 2-ethylhexyl group, an n-octyl group, a nonyl group, a decyl group, a lauryl group, a tridecyl group, a palmityl group, a stearyl group, an oleyl group, an eicosyl group, a butylphenyl group and a nonylphenyl group. The symbols m and n are each a positive integer with the proviso that the sum of m and n is 4.

In the general formula (XI), $R^{20}$ and $R^{21}$ each represent a $C_1$ to $C_{18}$ hydrocarbon group and may be the same as or different from each other. The hydrocarbon group preferably has 3 to 18 carbon atoms. As the $C_3$ to $C_{18}$ hydrocarbon group, there may be mentioned a $C_3$ to $C_{18}$ straight-chained or branched alkyl or alkenyl group, a $C_6$ to $C_{18}$ cycloalkyl group, a $C_6$ to $C_{18}$ aryl group, and a $C_7$ to $C_{18}$ alkylaryl or arylalkyl group. Specific examples of the hydrocarbon group include an isopropyl group, an n-propyl group, an n-butyl group, an isobutyl group, a sec-butyl group, an amyl group, a hexyl group, a cyclohexyl group, a 2-ethylhexyl group, an n-octyl group, a nonyl group, a decyl group, a lauryl group, a tridecyl group, a palmityl group, a stearyl group, an oleyl group, a butylphenyl group and a nonylphenyl group. The symbols p and q are each a positive integer with the proviso that the sum of p and q is 4.

In the general formula (XII), $R^{22}$ and $R^{23}$ each represent a $C_1$ to $C_{30}$ hydrocarbon group and may be the same as or different from each other. The hydrocarbon group preferably has 3 to 20 carbon atoms and may be, for example, a $C_5$ to $C_{20}$ straight-chained or branched alkyl or alkenyl group, a $C_6$ to $C_{20}$ cycloalkyl group and $C_6$ to $C_{20}$ aryl, alkylaryl and arylalkyl groups. Specific examples of the hydrocarbon group include an isopropyl group, an n-propyl group, an isobutyl group, an n-butyl group, a sec-butyl group, an amyl group, a hexyl group, a cyclohexyl group, a 2-ethylhexyl group, an n-octyl group, a nonyl group, a decyl group, a lauryl group, a tridecyl group, a palmityl group, a stearyl group, an oleyl group, a butylphenyl group and a nonylphenyl group. The symbols X and Y each represent an oxygen atom or a sulfur atom and may be the same as or different from each other. In the composition of the present invention, MoDTCs represented by the above general formula (X) may be used singly or in combination of two or more thereof. Also, MoDTPs represented by the above general formula (XI) may be used singly or in combination of two or more thereof, and MoDTXs represented by the above general formula (XII) may be used singly or in combination of two or more thereof.

As the molybdenum-amine complex, a hexavalent molybdenum compound, to be more specific, a product obtained by reaction of molybdenum trioxide and/or molybdenic acid with an amine compound, for example, a compound obtained by the method disclosed in Japanese Unexamined Patent Application Publication No. 2003-252887, may be used.

The amine compound to be reacted with the hexavalent molybdenum compound is not specifically limited. Examples of the amine compound include monoamines, diamines, polyamines and alkanolamines. More specific examples include alkylamines having a $C_1$ to $C_{30}$ straight-chained or branched alkyl group, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine and propylbutylamine; alkenylamines having a $C_2$ to $C_{30}$ straight-chained or branched alkenyl group, such as ethenylamine, propenylamine, butenylamine, octenylamine and oleylamine; alkanolamines having a $C_1$ to $C_{30}$ straight-chained or branched alkanol group, such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine and propanolbutanolamine; alkylenediamines having a $C_1$ to $C_{30}$ alkylene group, such as methylenediamine, ethylenediamine, propylenediamine and butylenediamine; polyamines such as diethylenetriamine, triethylenetetramine, tetraethylenepentamine and pentaethylenehexamine; compounds having a $C_8$ to $C_{20}$ alkyl or alkenyl group bonded to the above-exemplified monoamines, diamines and polyamines, such as undecyldiethylamine, undecyldiethanolamine, dodecyldipropanolamine, oleyldiethanolamine, oleylpropylenediamine and stearyltetraethylenepentamine; and heterocyclic compounds such as imidazoline; alkylene oxide adducts of these compounds; and mixtures of these compounds. Among these amine compounds, primary amines, secondary amines and alkanolamines are preferred.

The hydrocarbon groups of these amine compounds preferably have a carbon number of 4 or more, more preferably 4 to 30, particularly preferably 8 to 18. When the carbon number of the hydrocarbon group of the amine compounds is less than 4, the solubility tends to be reduced. When the carbon number of the amine compound is not greater than 30, the molybdenum content in the molybdenum-amine complex becomes relatively high. Therefore, the desired effect is obtainable even with a small amount of the complex. The amine compounds may be used singly or in combination of two or more thereof.

The hexavalent molybdenum compound is preferably reacted with the amine compound in such an amount that the molar ratio of the Mo atom of the molybdenum compound to the amine compound is 0.7:1 to 5:1, more preferably 0.8:1 to 4:1, still more preferably 1:1 to 2.5:1. The reaction method is not specifically limited. A known method such as disclosed in Japanese Unexamined Patent Application Publication No. 2003-252887 may be adopted.

Not only the above-described sulfurized oxymolybdenum dithiocarbamate, sulfurized oxymolybdenum dithiophosphate, sulfurized oxymolybdenum dithioxantogenate and molybdenum-amine complexes, but also trinuclear molybdenum-sulfur compounds (disclosed in Japanese Translation of PCT International Application Publication No. 2003-523454, Japanese Translation of PCT International Application Publication No. 2003-500521 and Japanese Unexamined Patent Application Publication No. 2004-51985) and sulfur-containing molybdenum complexes of succinimide (disclosed in Japanese Examined Patent Publication No. H03-22438 and Japanese Unexamined Patent Application Publication No. 2004-2866) may be used as the organomolybdenum compound used as component (B) in the present invention.

These molybdenum-containing compounds in the lubricating oil composition serve to function mainly as a friction modifier, an antioxidant or a wear preventing agent. From the standpoint of performance and influence upon an exhaust gas purifying catalyst, the nitrogen-containing molybdenum compounds such as sulfurized oxymolybdenum dithiocarbamate, molybdenum-amine complexes and sulfur-containing molybdenum complexes of succinimide are preferred. The trinuclear molybdenum-sulfur compounds are also preferred. In the present invention, the molybdenum-containing compounds may be used singly or in combination of two or more thereof as component (B).

The content of component (B) in the lubricating oil composition is advantageously determined so that the lubricating oil composition has a molybdenum content of preferably 2,000 ppm by mass or less, more preferably 50 to 1,500 ppm by mass, from the viewpoint of a balance between the effect, solubility and economical efficiency. When a sulfur-containing molybdenum compound is used as the organomolybdenum compound, it is preferred that the lubricating oil composition contain the organomolybdenum compound in an amount so that the total sulfur content of the lubricating oil composition is 0.3% by mass or less, more preferably 0.05 to 0.2% by mass.

The lubricating oil composition of the present invention must contain a phenol-based antioxidant and/or an amine-based antioxidant as component (C).

As the phenol-based antioxidant, any known phenol-based antioxidant that has been used as an antioxidant for conventional lubricating oil may be arbitrarily used. Such a phenol-based antioxidant may be, for example, 2,6-di-tert-butyl-4-methylphenol, 2,6-di-tert-butyl-4-ethylphenol, 2,4,6-tri-tert-butylphenol, 2,6-di-tert-butyl-4-hydroxymethylphenol, 2,6-di-tert-butylphenol, 2,4-dimethyl-6-tert-butylphenol, 2,6-di-tert-butyl-4-(N,N-dimethylaminomethyl)phenol, 2,6-di-tert-amyl-4-methylphenol, 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,4-dimethyl-6-tert-butylphenol, 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl) sulfide, 2,2'-thio-diethylenebis[3-(3,5-di-tert-butyl-4-hydroxyphenyl)propionate], tridecyl-3-(3,5-di-tert-butyl-4-hydroxyphenyl)propionate, pentaerythrityl-tetrakis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate and octyl-3-(3-methyl-5-tert-butyl-4-hydroxyphenyl)propionate.

As the amine-based antioxidant, any known amine-based antioxidant that has been used as an antioxidant for conventional lubricating oil may be arbitrarily used. Such an amine-based antioxidant may be, for example, a diphenylamine compound such as diphenylamine or an alkylated diphenylamine having a $C_3$ to $C_{20}$ alkyl group or groups (e.g. monooctyldiphenylamine, monononyldiphenylamine, 4,4'-dibutyldiphenylamine, 4,4'-dihexyldiphenylamine, 4,4'-dioctyldiphenylamine, 4,4'-dinonyldiphenylamine, tetrabutyldiphenylamine, tetrahexyldiphenylamine, tetraoctyldiphenylamine and tetranonyldiphenylamine); or a naphthylamine compound such as α-naphthylamine, phenyl-α-naphthylamine or an alkylated phenyl-α-naphthylamine having a $C_3$ to $C_{20}$ alkyl group or groups (e.g., butylphenyl-α-naphthylamine, hexylphenyl-α-naphthylamine, octylphenyl-α-naphthylamine, and nonylphenyl-α-naphthylamine). Among these compounds, diphenylamine compounds are more suitable than naphthylamine compounds from the viewpoint of effectiveness. Particularly, alkylated diphenylamines having a $C_3$ to $C_{20}$ alkyl group or groups, especially 4,4'-di($C_3$ to $C_{20}$ alkyl)diphenylamines, are preferred.

In the present invention, the above phenol-based antioxidants as component (C) may be used singly or in combination of two or more thereof. Similarly, the above amine-based antioxidants may be used singly or in combination of two or more thereof. Further, one or more kinds of the phenol-based antioxidants and one or more kinds of the amine-based antioxidants may be more suitably used in combination.

In the present invention, the content of component (C) is preferably 0.05% to 3.0% by mass, more preferably 0.2% to 2.0% by mass, based on the total amount of the lubricating oil composition from the standpoint of a balance between effects and economical efficiency.

The lubricating oil composition of the present invention may additionally contain, as component (D), an ashless dispersant and/or a metal-based detergent, if desired.

As the ashless dispersant, there may be mentioned a monotype alkenyl- or alkyl-succinimide represented by the general formula (XIII), a bis-type alkenyl- or alkyl-succinimide represented by the general formula (XIV), and/or a boron derivative thereof, and/or an organic acid-modified product thereof.

[Chemical Formula 2]

(XIII)

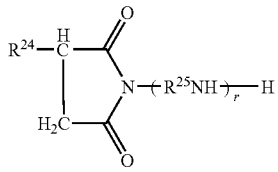

(XIV)

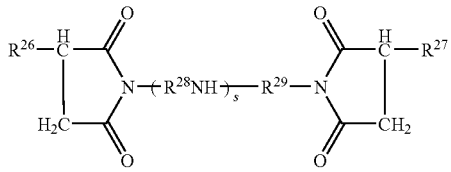

In the above formulas, $R^{24}$, $R^{26}$ and $R^{27}$ each represent an alkenyl or alkyl group having a number average molecular weight of 500 to 3,000 with the proviso that $R^{26}$ and $R^{27}$ may be the same as or different from each other, $R^{25}$, $R^{28}$ and $R^{29}$ each represent a $C_2$ to $C_5$ alkylene group with the proviso that $R^{28}$ and $R^{29}$ may be the same as or different from each other, r is an integer of 1 to 10, and s is 0 or an integer of 1 to 10.

In the general formulas (XIII) and (XIV), each of $R^{24}$, $R^{26}$ and $R^{27}$ is an alkenyl or alkyl group having a number average molecular weight of preferably 500 to 3,000, more preferably 1,000 to 3,000. When the number average molecular weight of each of $R^{24}$, $R^{26}$ and $R^{27}$ is less than 500, the solubility of the succinimide in a base oil is reduced. When the number average molecular weight exceeds 3,000, the detergency is reduced. Thus, in either case, there is a possibility that the object of the present invention may not be achieved. The symbol r is preferably 2 to 5, more preferably 3 or 4. When r is less than 2, the detergency is deteriorated. When r is 6 or more, the solubility in the base oil is not good.

In the general formula (XIV), s is preferably 1 to 4, more preferably 2 or 3. When s is 0, the detergency is deteriorated. When s is 5 or more, the solubility in the base oil becomes unsatisfactory. The alkenyl group may be a polybutenyl group, a polyisobutenyl group, or an ethylene-propylene copolymer. The alkyl group may be a hydrogenated group of the above alkenyl group.

Typical examples of the suitable alkenyl group include a polybutenyl group and a polyisobutenyl group. The polybutenyl group may be a polymer obtained by polymerizing a mixture of 1-butene and isobutene, or high purity isobutene.

Typical examples of the suitable alkyl group include a hydrogenated group of a polybutenyl group or a polyisobutenyl group.

The alkenyl- or alkyl-succinimide may be produced by reacting an alkenylsuccinic anhydride, obtained by reaction of a polyolefin and maleic anhydride, or an alkylsuccinic anhydride, obtained by hydrogenation of the alkenylsuccinic anhydride, with a polyamine.

By changing the amount of the alkenyl- or alkyl-succinic anhydride relative to the polyamine, the above reaction results in the mono-type succinimide and/or the bis-type succinimide.

As an olefin monomer from which the above polyolefin is formed, there may be used a $C_2$ to $C_8$ α-olefin or a mixture of two or more such α-olefins. A mixture of isobutene and butane-1 is preferably used.

As the polyamine, there may be mentioned diamines, such as ethylenediamine, propylenediamine, butylenediamine and pentylenediamine, and polyalkylenepolyamines such as diethylenetriamine, triethylenetetramine, tetraethylenepentamine, pentaethylenehexamine, di(methylethylene)triamine, dibutylenetriamine, tributylenetetramine and pentapentylenehexamine.

Any boron derivative of an alkenyl- or alkyl-succinimide compound which is produced by a conventional method may be employed.

For example, the aforementioned polyolefin is reacted with maleic anhydride to form an alkenylsuccinic anhydride. The anhydride is imidized with an intermediate product, which is obtained by reaction of the above polyamine with a boron compound such as boron oxide, boron halide, boric acid, boric anhydride, boric acid ester or ammonium borate, thereby obtaining the boron derivative.

No particular limitation is imposed on the boron content of the boron derivative. Generally, however, the boron content is 0.05 to 5% by mass, preferably 0.1 to 3% by mass, in terms of boron.

As the metal-based detergent, any alkaline earth metal-based detergent used for a lubricating oil may be used. Examples of the detergent include alkaline earth metal sulfonates, alkaline earth metal phenates, alkaline earth metal salicylates and mixtures of two or more thereof. As the alkaline earth metal sulfonates, there may be mentioned alkaline earth metal salts, such as magnesium and/or calcium salts, particularly preferably calcium salts, of alkyl aromatic sulfonic acids obtained by sulfonating alkyl aromatic compounds having a molecular weight of 300 to 1,500, preferably 400 to 700. As the alkaline earth metal phenates, there may be mentioned alkaline earth metal salts, such as magnesium and/or calcium salts, particularly preferably calcium salts, of alkylphenols, alkylphenolsulfides or Mannich reaction products of alkylphenols. As the alkaline earth metal salicylates, there may be mentioned alkaline earth metal salts, such as magnesium and/or calcium salts, particularly preferably calcium salts, of alkylsalicylic acids. The alkyl group constituting the above alkaline earth metal-based detergent is preferably a $C_4$ to $C_{30}$ alkyl group, more preferably a $C_6$ to $C_{18}$ straight-chained or branched alkyl group. Specific examples of the alkyl group include a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an icosyl group, a heneicosyl group, a docosyl group, a tricosyl group, a tetracosyl group, a pentacosyl group, a hexacosyl group, a heptacosyl group, an octacosyl group, a nonacosyl group and a triacontyl group. These alkyl groups may be straight-chained or branched. They may be primary, secondary or tertiary alkyl groups. The alkaline earth metal sulfonate, alkaline earth metal phenate and alkaline earth metal salicylate may be a neutral alkaline earth metal sulfonate, a neutral alkaline earth metal phenate and a neutral alkaline earth metal salicylate, respectively, which are obtained, for example, by directly reacting the above-described compound (namely, an alkylaromatic sulfonic acid, an alkylphenol, an alkylphenolsulfide, a Mannich reaction product of an alkylphenol or an alkylsalicylic acid) with an alkaline earth metal base, such as an oxide or hydroxide of an alkaline earth metal or metals (magnesium and/or calcium), or by first converting the above-described compound into an alkali metal salt such as a sodium salt and a potassium salt and then converting the alkali metal salt into an alkaline earth metal salt. Further, a basic alkaline earth metal sulfonate, a basic alkaline earth metal phenate and a basic alkaline earth metal salicylate, obtained by heating the above neutral alkaline earth metal sulfonate, neutral alkaline earth metal phenate and neutral alkaline earth metal salicylate, respectively, with an excess amount of an alkaline earth metal salt or an alkaline earth metal base in the presence of water, may be also used. Moreover, an overbased alkaline earth metal sulfonate, an overbased alkaline earth metal phenate and an overbased alkaline earth metal salicylate, obtained by reacting the above neutral alkaline earth metal sulfonate, neutral alkaline earth metal phenate and neutral alkaline earth metal salicylate with an alkaline earth metal carbonate or borate in the presence of carbon dioxide, may be used as the detergent.

Thus, the metal-based detergent used for the purpose of the present invention may be the above-described neutral salts, basic salts, overbased salts and mixtures thereof and is particularly preferably a mixture of a neutral sulfonate with at least one of the overbased salicylates, overbased phenates and overbased sulfonates, for reasons of detergency and wear resistance in an engine.

Metal-based detergents are generally commercially available in a form diluted with a light lubricating base oil. It is desirable to use a metal-based detergent having a metal content of generally 1.0 to 20% by mass, preferably 2.0 to 16% by mass.

The metal-based detergent used in the present invention generally has a total base number of 10 to 500 mg KOH/g, preferably 15 to 450 mg KOH/g. One or a plurality of detergents may be selected from those detergents having total base numbers of the above range. The term "total base number" as used herein is as measured by "Potential difference titration method" (base number; perchloric acid method) in accordance with Section 7 of JIS K2501, "Petroleum products and Lubricants; Determination of neutralization number".

There are no particular restrictions on the metal ratio of the metal-based detergent of the present invention. Generally, metal-based detergents having a metal ratio of 20 or less may be used singly or in combination of two or more thereof. In either case, it is preferred that at least one metal-based detergent used have a metal ratio of 3 or less, more preferably 1.5 or less, particularly preferably 1.2 or less, for reasons of excellent oxidation stability, ability to retain the base number and high-temperature detergency. The term "metal ratio" as used herein is intended to be represented by: (valency of metal element of the metal-based detergent)×(metal element content (mole %))/(soap content (mole %)) where "metal element" represents calcium, magnesium or the like element and "soap" represents a sulfonic acid group, a phenol group, a salicylic acid group or the like group.

The content of the metal-based detergent in the present invention is generally 1% by mass or less, preferably 0.5% by mass or less, in terms of metal element. The content is more preferably 0.3% by mass or less in order to reduce the sulfated ash content of the composition to 1.0% by mass or less. The content of the metal-based detergent is 0.005% by mass or more, preferably 0.01% by mass or more, in terms of metal element. The content is more preferably 0.05% by mass or more, because the composition can maintain its base number and high-temperature detergency for a long period of time. The term "sulfated ash content" as used herein is as measured by the method specified in "Testing method for sulfuric ash content", Section 5 of JIS K2272, and the ash is mainly attributed to metal-containing additives.

The lubricating oil composition of the present invention may contain a variety of additives such as a friction modifier other than those mentioned above (an oiliness agent or an extreme pressure additive), an antiwear agent, a viscosity index improver, a pour-point depressant, a rust preventive agent, a metal corrosion inhibitor, an antifoaming agent and a surfactant.

As the antiwear agent, there may be mentioned sulfur-containing antiwear additives such as zinc dithiophosphate, zinc dithiocarbamate, disulfides, sulfurized olefins, sulfurized fats and oils, sulfurized esters, thiocarbonates and thiocarbamates; phosphorus-containing antiwear additives such as phosphite esters, phosphate esters, phosphonic acid esters and amine salts and metal salts thereof; and sulfur- and phosphorus-containing antiwear additives such as thiophosphite esters, thiophosphate esters, thiophosphonic acid esters and amine salts and metal salts thereof.

As the friction modifier, it is possible to use any compound customarily employed as a friction modifier for lubricating oils. For example, there may be used an ashless friction modifier having at least one $C_6$ to $C_{30}$ alkyl or alkenyl group, particularly $C_6$ to $C_{30}$ straight-chained alkyl or straight-chained alkenyl group in the molecule, such as an aliphatic amine, a fatty acid ester, a fatty acid amide, a fatty acid, an aliphatic alcohol or an aliphatic ether. The friction modifier is generally used in an amount of 0.01 to 3% by mass, preferably 0.1 to 1.5% by mass.

As the rust preventive agent, there may be mentioned, for example, petroleum sulfonates, alkylbenzene sulfonates, dinonylnaphthalene sulfonate, alkenylsuccinic acid esters and esters of polyhydric alcohols. The compounding amount of the rust preventive agent is generally 0.01 to 1% by mass, preferably 0.05 to 0.5% by mass, based on a total weight of the lubricating oil composition, from the standpoint of effectiveness.

As a metal deactivator, there may be used, for example, benzotriazoles, tolyltriazoles, thiadiazoles and imidazoles. The compounding amount of the metal deactivator is generally 0.01 to 1% by mass, preferably 0.01 to 0.5% by mass, based on the total amount of the lubricating oil composition, from the standpoint of effectiveness.

As the viscosity index improver, there may be mentioned, for example, polymethacrylate, dispersion type polymethacrylate, olefin copolymers (for example, ethylene-propylene copolymers), dispersion type olefin copolymers and styrene-based copolymers (for example, styrene-diene copolymers and styrene-isoprene copolymers).

The compounding amount of the viscosity index improver is generally 0.5 to 15% by mass, preferably 1 to 10% by mass, based on the total amount of the lubricating oil composition, from the standpoint of effectiveness.

As the pour point depressant, there may be mentioned, for example, polymethacrylate having a weight average molecular weight of 5,000 to 50,000.

As the antifoaming agent, there may be mentioned, for example, silicone, fluorosilicone and fluoroalkyl ethers. The content of the antifoaming agent is preferably 0.005 to 0.1% by mass based on the total amount of the lubricating oil composition from the standpoint of a balance between the antifoaming effect and economical efficiency.

As the surfactant, there may be mentioned, for example, polyalkylene glycol-based nonionic surfactants such as polyoxyethylene alkyl ethers, polyoxyethylene alkylphenyl ethers and polyoxyethylene alkylnaphthyl ethers.

It is preferred that the lubricating oil composition of the present invention have a phosphorus content of 0.1% by mass or less. This is for reasons of suppressing reduction of performance of an exhaust gas purifying catalyst. The phosphorus content is more preferably 0.08% by mass or less, still more preferably 0.05% by mass or less.

It is also preferred that the sulfated ash content be 1.0% by mass or less. This is for reasons of suppressing reduction of performance of an exhaust gas purifying catalyst. Additionally, in the case of a diesel engine, the amount of ash deposits on a DPF filter is small when the sulfated ash content is 1.0% by mass or less. Therefore, clogging of the filter by ash is suppressed so that the service life of the DPF is prolonged. The sulfated ash content is more preferably 0.8% by mass or less, still more preferably 0.5% by mass or less.

The "sulfated ash content" as used herein may be measured by a method in which carbonized residues obtained by combustion of a sample are added with sulfuric acid, the resulting mixture being heated until weight becomes constant. This constant value is designated as the sulfated ash content, which may be generally used to determine an approximate content of metal-based additives contained in a lubricating oil composition.

The lubricating oil composition of the present invention is a lubricating oil composition for internal combustion engines which has excellent oxidation stability and friction reducing effect, which is low in phosphorus content and in sulfated ash content and which complies with environmental regulations and, therefore, may be used for internal combustion engines such as gasoline engines, diesel engines and gas engines.

EXAMPLES

The present invention will be next described in further detail by way of Examples but is not limited to these Examples in any way.

The properties referred to in each example were determined by the following methods.

Properties of Base Oil and Lubricating Oil Composition (1) Kinematic Viscosity of Base Oil and Lubricating Oil Composition:

Kinematic viscosity was measured in accordance with "Determination of kinematic viscosity for petroleum products" specified in JIS K2283.

(2) Viscosity Index of Base Oil:

Viscosity index was measured in accordance with "Determination of kinematic viscosity for petroleum products" specified in JIS K2283.

(3) Sulfur Content of Base Oil and Lubricating Oil Composition:

Sulfur content was measured in accordance with JIS K2541.

(4) % $C_A$ of Base Oil:

A content (percentage) of aromatic components was calculated in accordance with the n-d-M ring analysis method.

(5) NOACK Evaporation of Base Oil:

NOACK evaporation was measured in accordance with JPI-5S-41-2004.

Lubricating Oil Composition (6) Molybdenum and Phosphorus Contents:

Molybdenum and phosphorus contents were measured in accordance with JPI-5S-38-92.

(7) Sulfated Ash Content:

Sulfated ash content was measured in accordance with JIS K2272.

(8) Oxidation Degradation Test

Using ISOT tester, air was blown at a rate of 250 mL/min into a sample oil in the presence of a copper and iron catalyst to determine the following characteristics. Test temperature was 165.5° C.

(a) Kinematic Viscosity Ratio (40° C.)

Kinematic viscosity ratio (40° C.) was calculated according to the following equation:

Kinematic viscosity ratio (40° C.)=(Kinematic viscosity at 40° C. of the oil after the test)/(Kinematic viscosity at 40° C. of the oil before the test)

(b) Acid Value Increase

Acid value increase was calculated according to the following equation:

Acid value increase=(Acid value after the test)/(Acid value before the test)

The acid value was measured by potentiometry in accordance with "Determination of neutralization number for lubricant oils" specified in JIS K2501.

(c) Friction Coefficient (SRV at 100° C.)

Using SRV tester (manufactured by Optimol Inc.), the friction coefficient of the sample oil after the oxidation degradation test was measured under the following conditions.

(i) Test piece: (a)disc (made of SUJ-2), (b) cylinder (made of SUJ-2)

(ii) Amplitude: 1.5 mm (iii) Frequency: 50 Hz (iv) Load: 400 N (v) Temperature: 100° C.

Components used for the preparation of lubricating oil compositions are as follows:

(1) Base oil A: hydrorefined base oil (kinematic viscosity at 40° C.: 21 $mm^2/s$, kinematic viscosity at 100° C.: 4.5 $mm^2/s$, viscosity index: 127, % $C_A$: 0.1 or less, sulfur content: below 20 ppm by mass, NOACK evaporation: 13.3% by mass);

(2) Base oil B: hydrorefined base oil (kinematic viscosity at 40° C.: 91 $mm^2/s$, kinematic viscosity at 100° C.: 10.9 $mm^2/s$, viscosity index: 107, % $C_A$: 0.1 or less, sulfur content: below 20 ppm by mass, NOACK evaporation: 4.7% by mass);

(3) Viscosity index improver: polymethacrylate (weight average molecular weight: 420,000, resin content: 39% by mass);

(4) Pour point depressant: polyalkylmethacrylate (weight average molecular weight: 6,000);

(5) Disulfide compound A: bis(n-octoxycarbonylmethyl)disulfide (sulfur content: 15.8% by mass);

(6) Disulfide compound B: bis(n-butoxycarbonylmethyl)disulfide (sulfur content: 21.8% by mass);

(7) Zinc dialkyldithiophosphate: (Zn content: 9.0% by mass, phosphorus content: 8.2% by mass, sulfur content: 17.1% by mass, alkyl group: mixture of secondary butyl group and secondary hexyl group);

(8) Phenol-based antioxidant: octadecyl-3-(3,5-di-tert-butyl-4-hydroxyphenyl)propionate;

(9) Amine-based antioxidant: dialkyldiphenylamine (nitrogen content: 4.62% by mass);

(10) Molybdenum-amine complex: Sakura Lube S-710 (manufactured by Adeca Corporation, molybdenum content: 10% by mass);

(11) Mo DTC: (Mo content: 4.5% by mass, sulfur content: 4.9% by mass)

(12) Metal-based detergent A: overbased calcium salicylate (base number (perchloric acid method): 225 mg KOH/g, calcium content: 7.8% by mass, sulfur content: 0.3% by mass);

(13) Metal-based detergent B: overbased calcium salicylate (base number (perchloric acid method): 170 mg KOH/g, calcium content: 6.1% by mass, sulfur content: 0.07% by mass);

(14) Metal-based detergent C: calcium sulfonate (base number (perchloric acid method): 17 mg KOH/g, calcium content: 2.4% by mass, sulfur content: 2.8% by mass);

(15) Metal-based detergent D: overbased calcium phenate (base number (perchloric acid method): 255 mg KOH/g, calcium content: 9.3% by mass, sulfur content: 3.0% by mass);

(16) Polybutenylsuccinimide A: (number average molecular weight of polybutenyl group: 1,000, nitrogen content: 1.76% by mass, boron content: 2.0% by mass);

(17) Polybutenylsuccinimide B: (number average molecular weight of polybutenyl group: 1,000, nitrogen content: 1.23% by mass, boron content: 1.3% by mass);

(18) Polybutenylsuccinimide C: (number average molecular weight of polybutenyl group: 2,000, nitrogen content: 0.99% by mass);

(19) Polybutenylsuccinimide D: (number average molecular weight of polybutenyl group: 2,000, nitrogen content: 1.95% by mass, boron content: 0.67% by mass);

(20) Other additives: rust preventive agent, corrosion inhibitor, demulsifier and antifoaming agent.

Examples 1 and 2 and Comparative Examples 1, 2 and 3

Lubricating oil compositions having compositions shown in Table 1 were prepared. The properties of each of the lubricating oil compositions and the results after oxidation degradation test (144 hours) are shown in Table 1.

TABLE 1

| | | Example 1 | Example 2 | Comparative Example 1 | Comparative Example 2 | Comparative Example 3 |
|---|---|---|---|---|---|---|
| Compounding composition (% by mass) | Base oil A | 84.46 | 85.86 | 84.76 | 84.15 | 87.16 |
| | Viscosity index improver | 4.50 | 4.50 | 4.50 | 4.50 | 4.50 |
| | Pour point depressant | 0.30 | 0.30 | 0.30 | 0.30 | 0.30 |
| | Disulfide compound A | 0.64 | 0.64 | 0.64 | — | 0.64 |
| | Zinc dialkyldithiophosphate | — | — | — | 0.95 | — |
| | Phenol-based antioxidant | 0.50 | 0.50 | 0.50 | 0.50 | 0.50 |

TABLE 1-continued

| | | Example 1 | Example 2 | Comparative Example 1 | Comparative Example 2 | Comparative Example 3 |
|---|---|---|---|---|---|---|
| | Amine-based antioxidant | 0.80 | 0.50 | 0.80 | 0.80 | 0.50 |
| | Molybdenum-amine complex | 0.30 | 0.30 | — | 0.30 | — |
| | Metal-based detergent A | 2.40 | — | 2.40 | 2.40 | — |
| | Metal-based detergent B | 0.60 | — | 0.60 | 0.60 | — |
| | Metal-based detergent C | — | 1.90 | — | — | 1.90 |
| | Polybutenylsuccinimide A | 1.00 | — | 1.00 | 1.00 | — |
| | Polybutenylsuccinimide B | — | 1.00 | — | — | 1.00 |
| | Polybutenylsuccinimide C | 4.00 | 4.00 | 4.00 | 4.00 | 4.00 |
| | Other additives | 0.50 | 0.50 | 0.50 | 0.50 | 0.50 |
| Properties of composition | Molybdenum content (% by mass) | 0.030 | 0.030 | 0.000 | 0.030 | 0.000 |
| | Phosphorus content (% by mass) | 0.000 | 0.000 | 0.000 | 0.078 | 0.000 |
| | Sulfer content (% by mass) | 0.13 | 0.12 | 0.13 | 0.17 | 0.12 |
| | Sulfated ash content (% by mass) | 0.67 | 0.43 | 0.66 | 0.86 | 0.45 |
| | Frictional coefficient (SRV, 100° C.) | 0.090 | 0.090 | 0.087 | 0.145 | 0.088 |
| 144 hours after oxidation degradation test | Kinematic viscosity ratio (40° C.) | 1.11 | 1.05 | 4.46 | 1.69 | 2.31 |
| | Acid value increase (mg KOHg) | 2.08 | 1.19 | 22.05 | 8.64 | 8.68 |

As will be understood from Table 1, the lubricating oil compositions of the present invention (Examples 1 and 2) have better friction-reducing effect (smaller friction coefficients) and better oxidation stability (smaller kinematic viscosity ratio and smaller increase in acid value after the oxidation degradation test) than those of Comparative Example 2. Although the compositions of Comparative Examples 1 and 3, in which no organomolybdenum compounds are added, give friction-reducing effect comparable to that of the lubricating oil compositions of the present invention (Examples 1 and 2), the oxidation stability is inferior (larger kinematic viscosity ratio and larger increase in acid value after the oxidation degradation test) to that of the present invention.

Examples 3 and 4, and Comparative Example 4

Lubricating oil compositions having compositions shown in Table 2 were prepared. The properties of each of the lubricating oil compositions and the results after oxidation degradation test (96 hours) are shown in Table 2.

TABLE 2

| | | Example 3 | Example 4 | Comparative Example 4 |
|---|---|---|---|---|
| Compounding composition (% by mass) | Base oil A | 70.73 | 70.49 | 70.94 |
| | Base oil B | 10.00 | 10.00 | 10.00 |
| | Viscosity index improver | 6.00 | 6.00 | 6.00 |
| | Pour point depressant | 0.20 | 0.20 | 0.20 |
| | Disulfide compound B | 0.46 | 0.15 | — |
| | Zinc dialkyldithiophosphate | — | 0.55 | 0.55 |
| | Phenol-based antioxidant | 0.50 | 0.50 | 0.50 |
| | Amine-based antioxidant | 1.00 | 1.00 | 1.00 |
| | Molybdenum-amine complex | 0.30 | 0.30 | — |
| | MoDTC | 1.56 | 1.56 | 1.56 |
| | Metal-based detergent B | 0.85 | 0.85 | 0.85 |
| | Metal-based detergent D | 1.90 | 1.90 | 1.90 |
| | Polybutenylsuccinimide C | 4.00 | 4.00 | 4.00 |
| | Polybutenylsuccinimide D | 2.00 | 2.00 | 2.00 |
| | Other additives | 0.50 | 0.50 | 0.50 |
| Properties of composition | Molybdenum content (% by mass) | 0.100 | 0.100 | 0.070 |
| | Phosphorus content (% by mass) | 0.000 | 0.045 | 0.045 |
| | Sulfer content (% by mass) | 0.24 | 0.27 | 0.24 |
| | Sulfated ash content (% by mass) | 0.48 | 0.59 | 0.59 |

TABLE 2-continued

| | | Example 3 | Example 4 | Comparative Example 4 |
|---|---|---|---|---|
| | Frictional coefficient (SRV, 100° C.) | 0.046 | 0.048 | 0.047 |
| 96 hours after oxidation degradation test | Kinematic viscosity ratio (40° C.) | 1.02 | 1.01 | 1.05 |
| | Acid value increase (mg KOHg) | 1.22 | 0.87 | 1.50 |
| | Frictional coefficient (SRV, 100° C.) | 0.085 | 0.050 | 0.146 |

As will be understood from Table 2, the lubricating oil compositions of the present invention (Examples 3, 4 and 5) have better oxidation stability (smaller kinematic viscosity ratio and smaller increase in acid value after the oxidation degradation test) than those of Comparative Example 4. The lubricating oil compositions of the present invention also have better retentivity of friction-reducing effect (smaller friction coefficient after the oxidation degradation test).

INDUSTRIAL APPLICABILITY

The lubricating oil composition of the present invention is a lubricating oil composition for internal combustion engine which is low ash and low phosphorus, which has improved oxidation stability and friction reducing effect, and which complies with environmental regulations and, therefore, may be used for internal combustion engines such as gasoline engines, diesel engines and gas engines.

The invention claimed is:

1. A lubricating oil composition comprising:

a base oil having a kinematic viscosity at 100° C. of 2 to 30 $mm^2/s$, a % CA, as determined by ring analysis, of 3.0 or less, a sulfur content of 50 ppm by mass or less, and a viscosity index of 70 or more;

(A) at least one compound selected from the group consisting of disulfide compounds represented by formula (I):

$$R^1OOC\text{-}A^1\text{-}S\text{—}S\text{-}A^2\text{-}COOR^2 \quad (I)$$

wherein $R^1$ and $R^2$ each independently represent a $C_1$ to $C_{30}$ hydrocarbyl group, $A^1$ and $A^2$ each independently represent a group of the formula $CR^3R^4$ or $CR^3R^4$—$CR^5R^6$ where $R^3$ to $R^6$ each independently represent a hydrogen atom, wherein the content of component (A) is determined so that the lubricating oil composition has a sulfur content of 0.3% by mass or less, (B) a molybdenum-amine complex, wherein the content of component (B) is determined so that the lubricating oil composition has a molybdenum content of 50 to 2,000 ppm; and (C) 0.05% to 3.0% by mass based on the total mass of the lubricating oil composition of at least one of a phenol-based antioxidant and an amine-based antioxidant, wherein the lubricating oil composition has a phosphorus content of 0.1% by mass or less, and a sulfated ash content of 1.0% by mass or less.

2. The lubricating oil composition according to claim 1, further comprising (D) at least one of a metal-based detergent and an ashless dispersant.

3. The lubricating oil composition according to claim 1, wherein the lubricating oil composition has a molybdenum content of 50 to 1,500 ppm.

4. The lubricating oil composition according to claim 1, comprising at least one disulfide compound selected from the group consisting of bis(methoxycarbonylmethyl)disulfide, bis(ethoxycarbonylmethyl)disulfide, bis(n-propoxycarbonylmethyl)disulfide, bis(isopropoxycarbonylmethyl)disulfide, bis(n-butoxycarbonylmethyl)disulfide, bis(n-octoxycarbonyl-methyl)disulfide, bis(n-dodecyloxycarbonylmethyl)disulfide, bis(cyclopropoxycarbonylmethyl)disulfide, 1,1-bis(1-methoxycarbonylethyl)disulfide, 1,1-bis(1-methoxycarbonyl-n-propyl)disulfide, 1,1-bis(1-methoxycarbonyl-n-butyl)disulfide, 1,1-bis(1-methoxycarbonyl-n-hexyl)disulfide, 1,1-bis(1-methoxycarbonyl-n-octyl)disulfide, 1,1-bis(1-methoxycarbonyl-n-dodecyl)disulfide, 2,2-bis(2-methoxycarbonyl-n-propyl)disulfide, α,α-bis(α-methoxycarbonylbenzyl)disulfide, 1,1-bis(2-methoxycarbonylethyl)disulfide, 1,1-bis(2-ethoxycarbonylethyl)disulfide, 1,1-bis(2-n-propoxycarbonylethyl)disulfide, 1,1-bis(2-iso-propoxycarbonylethyl)disulfide, 1,1-bis(2-cyclopropoxycarbonylethyl)disulfide, 1,1-bis(2-methoxycarbonyl-n-propyl)disulfide, 1,1-bis(2-methoxycarbonyl-n-butyl)disulfide, 1,1-bis(2-methoxycarbonyl-n-hexyl)disulfide, 1,1-bis(2-methoxycarbonyl-n-propyl)disulfide, 2,2-bis(3-methoxycarbonyl-n-pentyl)disulfide and 1,1-bis(2-methoxycarbonyl-1-phenylethyl)disulfide.

5. The lubricating oil composition according to claim 1, wherein the content of component (A) is determined so that the lubricating oil composition has a total sulfur content of 0.05 to 0.2% by mass.

6. The lubricating oil composition according to claim 1, wherein the molybdenum-amine complex is obtained by reacting at least one of molybdenum trioxide and molybdenic acid with at least one amine compound.

7. The lubricating oil composition according to claim 6, wherein the at least one amine compound is a primary amine, secondary amine or alkanolamine.

8. The lubricating oil composition according to claim 7, wherein hydrocarbon groups of the at least one amine compound have a carbon number of 4 to 30.

9. The lubricating oil composition according to claim 8, wherein the carbon number is 8 to 18.

* * * * *